US006231126B1

(12) United States Patent
Cheng

(10) Patent No.: US 6,231,126 B1
(45) Date of Patent: May 15, 2001

(54) STRUCTURE FOR FASTENING A SUPPORT SHAFT TO A SEAT OF A CHAIR

(76) Inventor: Tien-Fu Cheng, No. 31, Sec. 2, To-Chang Rd., Tan-Tzu Hsiang, Taichung Hsien (TW)

( * ) Notice: Subject to any disclaimer, the term of this patent is extended or adjusted under 35 U.S.C. 154(b) by 0 days.

(21) Appl. No.: 09/626,765

(22) Filed: Jul. 27, 2000

(51) Int. Cl.[7] ..... A47B 97/00
(52) U.S. Cl. ..... 297/463.1; 297/326; 297/344.21
(58) Field of Search ..... 297/463.1, 326, 297/344.1, 344.21, 463.2; 248/188.1, 418

(56) References Cited

U.S. PATENT DOCUMENTS 2,729,273 * 1/1956 Hamilton et al. ..... 297/344.21 X
2,740,464 * 4/1956 Hamilton ..... 297/344.21 X
3,813,069 * 5/1974 Fletcher ..... 297/326 X
4,752,101 * 6/1988 Urchenco et al. ..... 297/326 X
4,915,449 * 4/1990 Piretti ..... 297/326

* cited by examiner

*Primary Examiner*—Laurie K. Cranmer
(74) *Attorney, Agent, or Firm*—Harrison & Egbert

(57) ABSTRACT

A structure fastens the seat of a chair to a support shaft of the base of the chair. The structure includes a fastening plate and a fastening seat. The fastening plate is fastened to the underside of the seat of the chair. The fastening seat is fastened pivotally to the fastening plate and is provided with a tapered protrusion having a through hole for receiving the support shaft of the base of the chair. The tapered protrusion is integrally made with the fastening seat.

1 Claim, 9 Drawing Sheets

STRUCTURE FOR FASTENING A SUPPORT SHAFT TO A SEAT OF A CHAIR

BACKGROUND OF THE INVENTION

1. Field of the Invention

The present invention relates generally to a chair, and more particularly to a structure for fastening a seat to a support shaft of the chair.

2. Description of Related Art

As shown in FIGS. 1–5, a prior art chair has a seat 11, which is supported by a support shaft 19 of a base 18 of the chair. The seat 11 is provided in the underside with a fastening seat 12 fastened thereto. The fastening seat 12 is provided with a swing seat 20 which is pivoted to the fastening seat 12 by a pivot 14 and is provided with a resilient member 15. The resilient member 15 is linked with the fastening seat 12. The fastening seat 12 is provided with two ribs 13 which are provided with an arcuate through hole 16 for receiving a wrenching rod 17. The swing seat 20 is provided with a locating hole 21 and a locating plate 22 which is fastened to the swing seat 20 by welding and is provided with a fitting hole 23 for receiving the support shaft 19 in conjunction with the locating hole 21. The locating plate 22 and the swing seat 20 are separately made by punching and pressing and are therefore not cost-effective.

BRIEF SUMMARY OF THE INVENTION

The primary objective of the present invention is to provide a cost-effective structure for fastening a seat to a support shaft of the chair.

In keeping with the principle of the present invention, the foregoing objective of the present invention is attained by the structure comprising a fastening plate secured to the underside of the seat, and a fastening seat which is pivoted to the fastening plate and is provided with a tapered protrusion made integrally with the fastening seat.

The features, functions, and advantages of the present invention will be more readily understood upon a thoughtful deliberation of the following detailed description of the preferred embodiment of the present invention with reference to the accompanying drawings.

BRIEF DESCRIPTION OF THE SEVERAL VIEWS OF THE DRAWINGS

FIG. 8 shows a sectional view of the fastening structure of the present invention in.

DETAILED DESCRIPTION OF THE INVENTION

Figure 1:
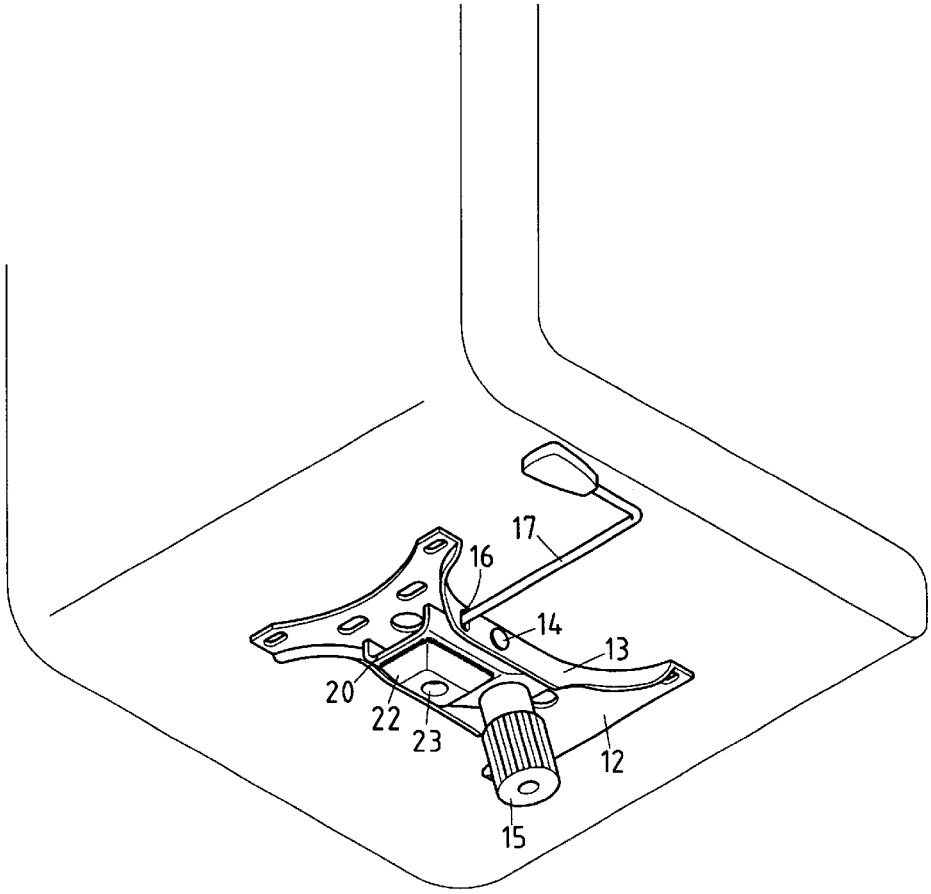
FIG.1 PRIOR ART
FIG. 1 shows a perspective view of a fastening structure of the prior art.
Figure 2:
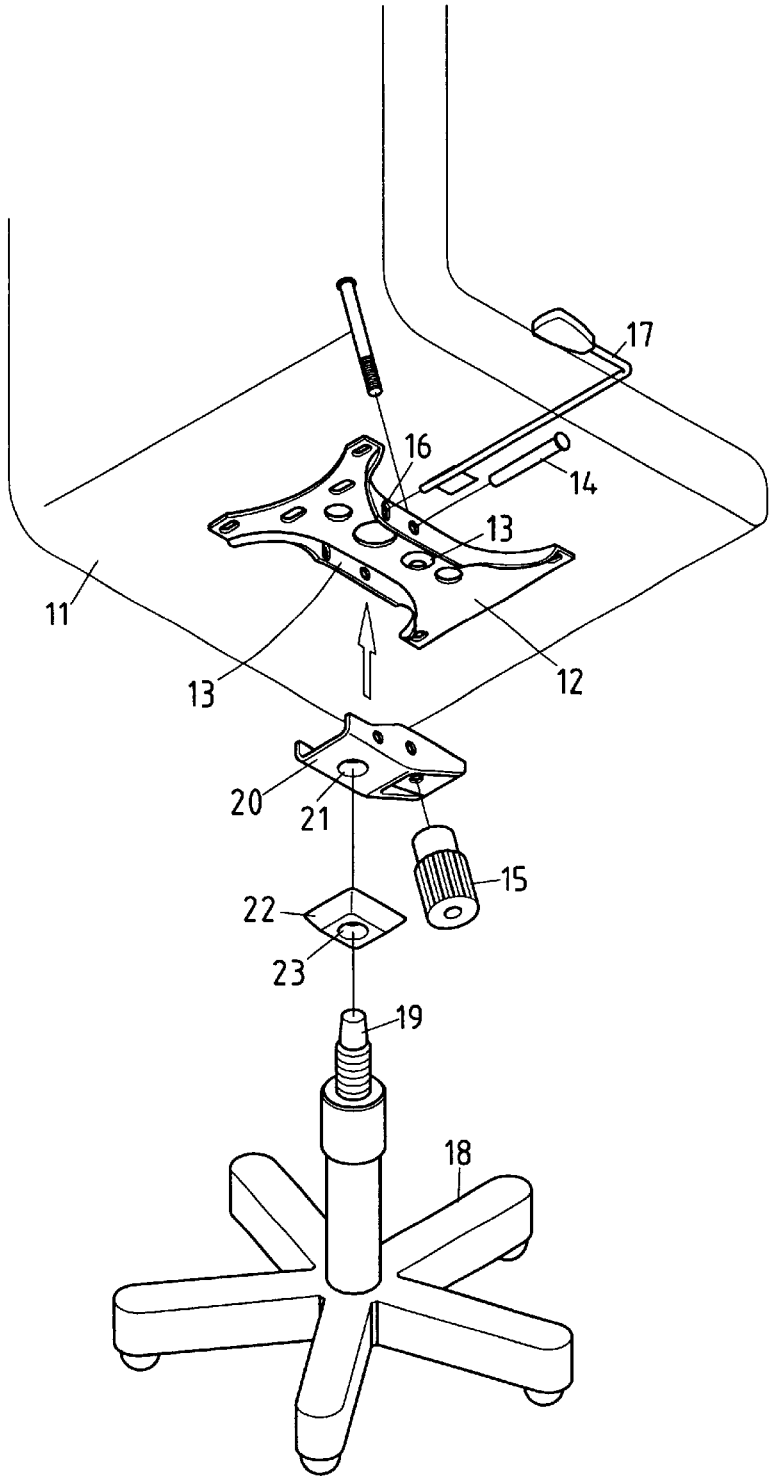
FIG. 2 PRIOR ART
FIG. 2 shows an exploded view of the fastening structure of the prior art.
Figure 3:
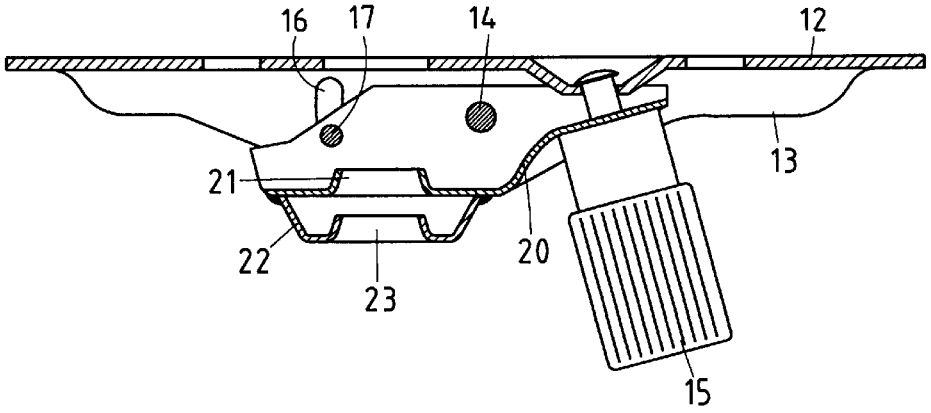
FIG.3 PRIOR ART
FIG. 3 shows a sectional view of the fastening structure of the prior art.
Figure 4:
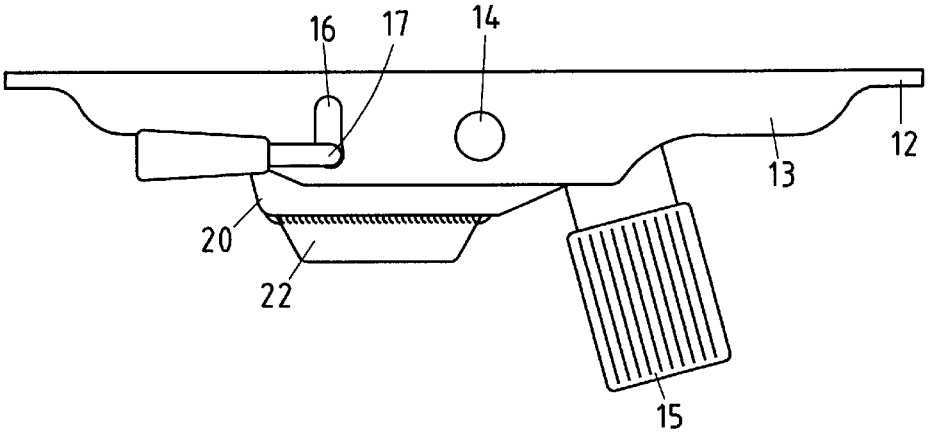
FIG.4 PRIOR ART
FIG. 4 shows a side schematic view of the fastening structure of the prior art.
Figure 5:
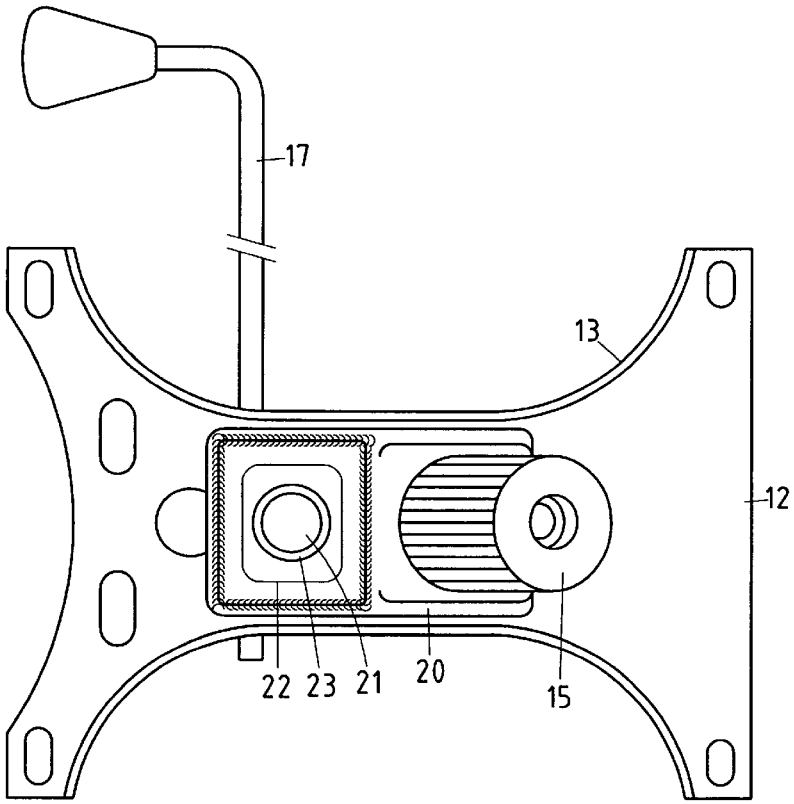
FIG.5 PRIOR ART
FIG. 5 shows a bottom schematic view of the fastening structure of the prior art.
Figure 6:
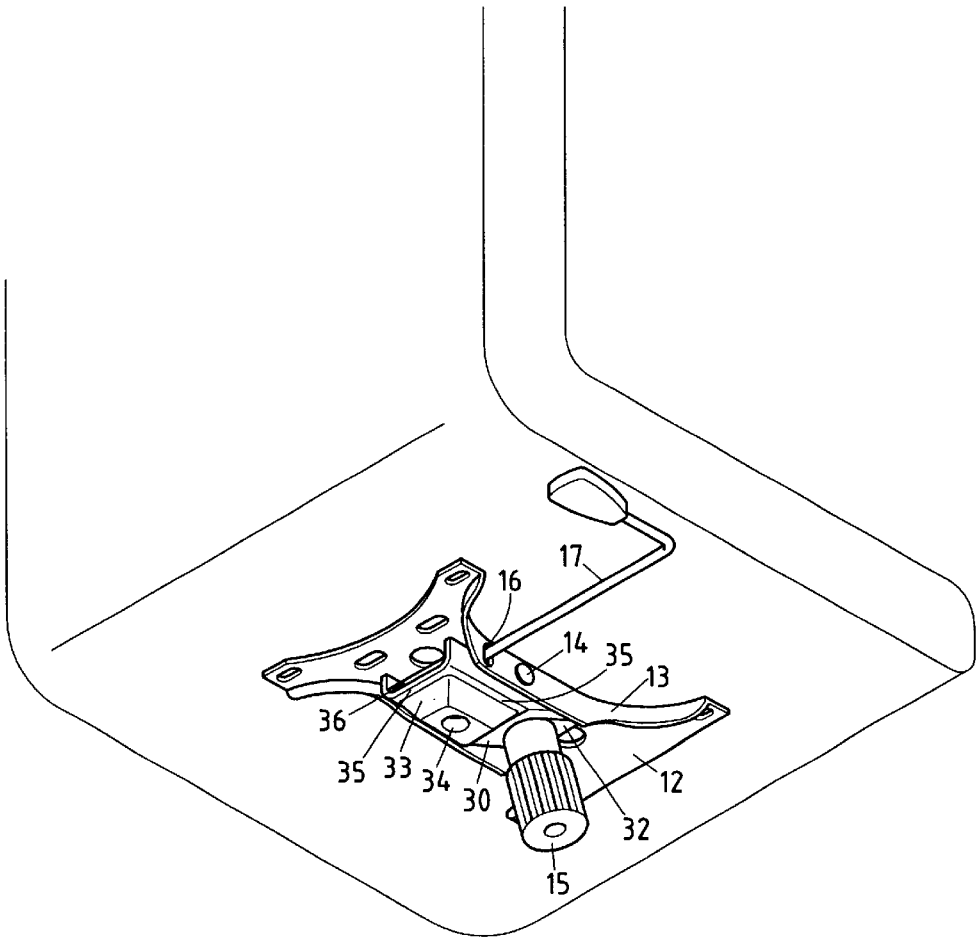
FIG. 6 shows another perspective view of the fastening structure of the present invention.
Figure 7:
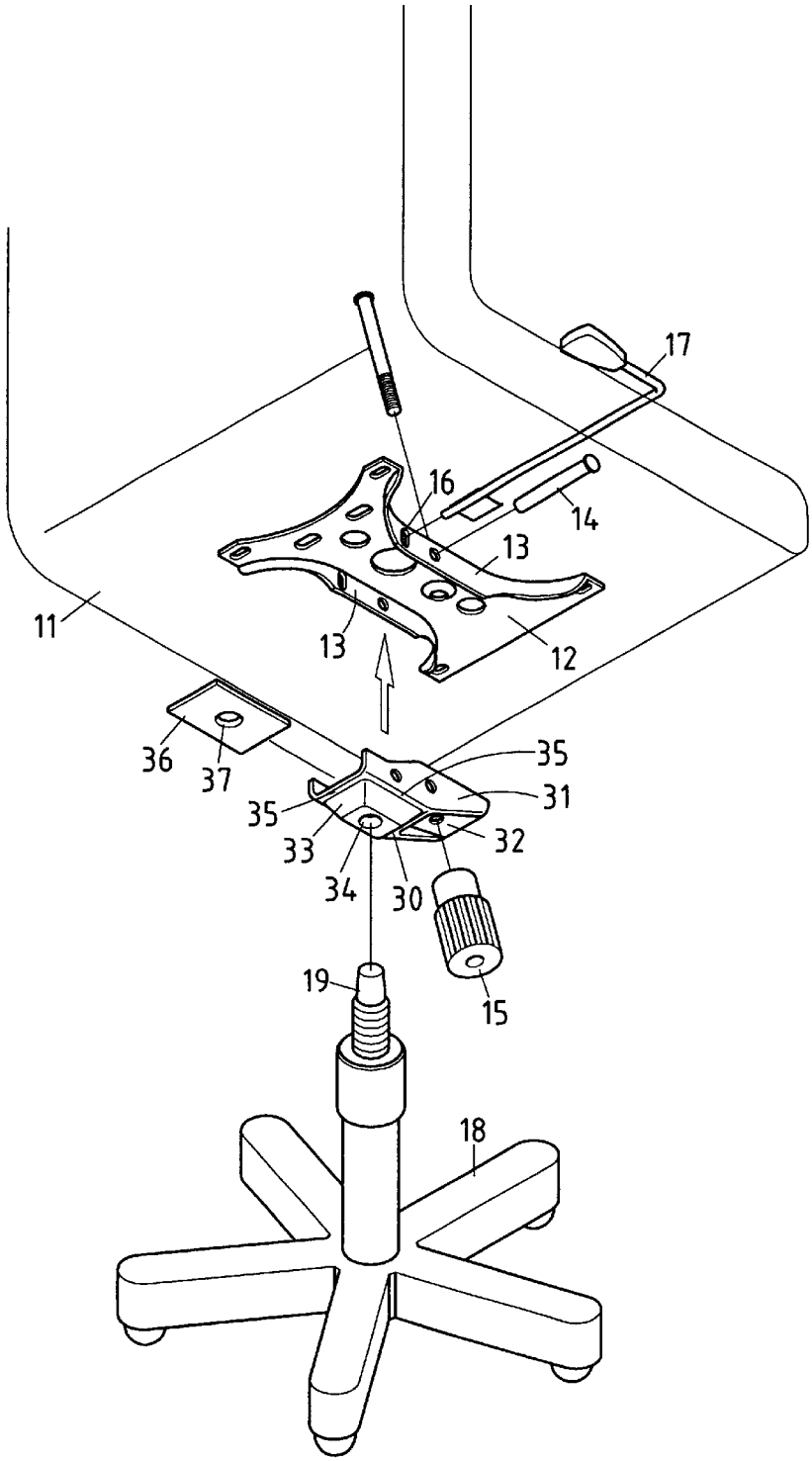
FIG. 7 shows an exploded view of a fastening structure of the present invention.
Figure 8:
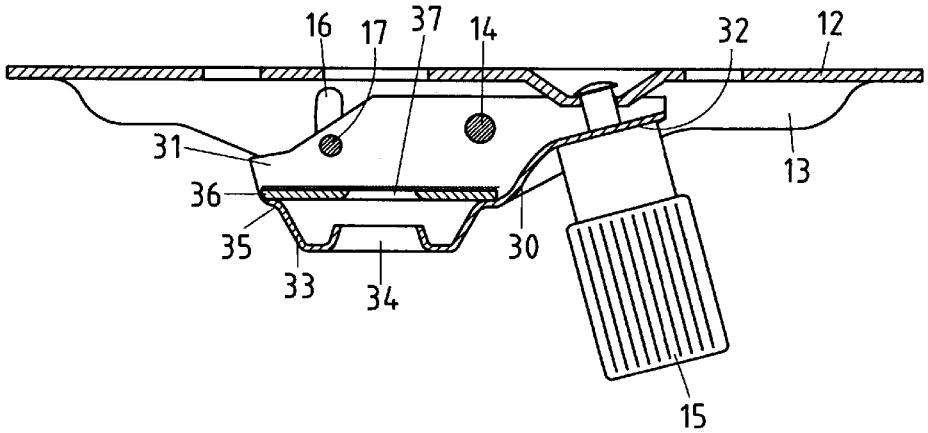
Figure 9:
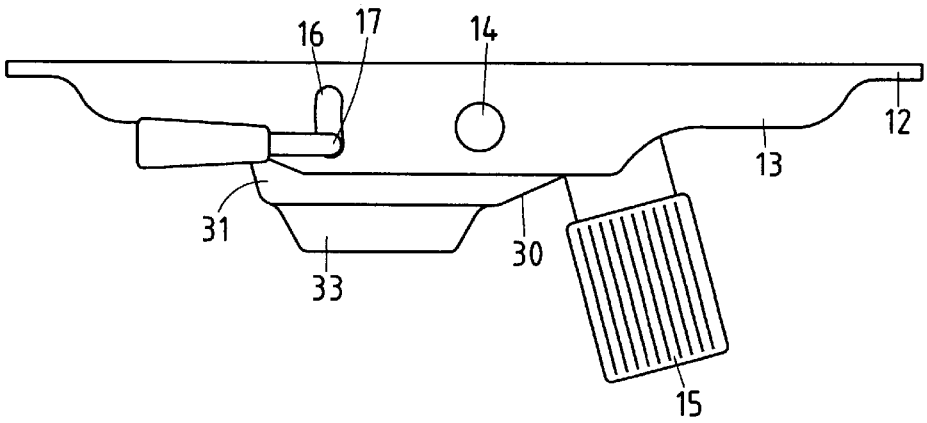
FIG. 9 shows a side schematic view of the fastening structure of the present invention.
Figure 10:
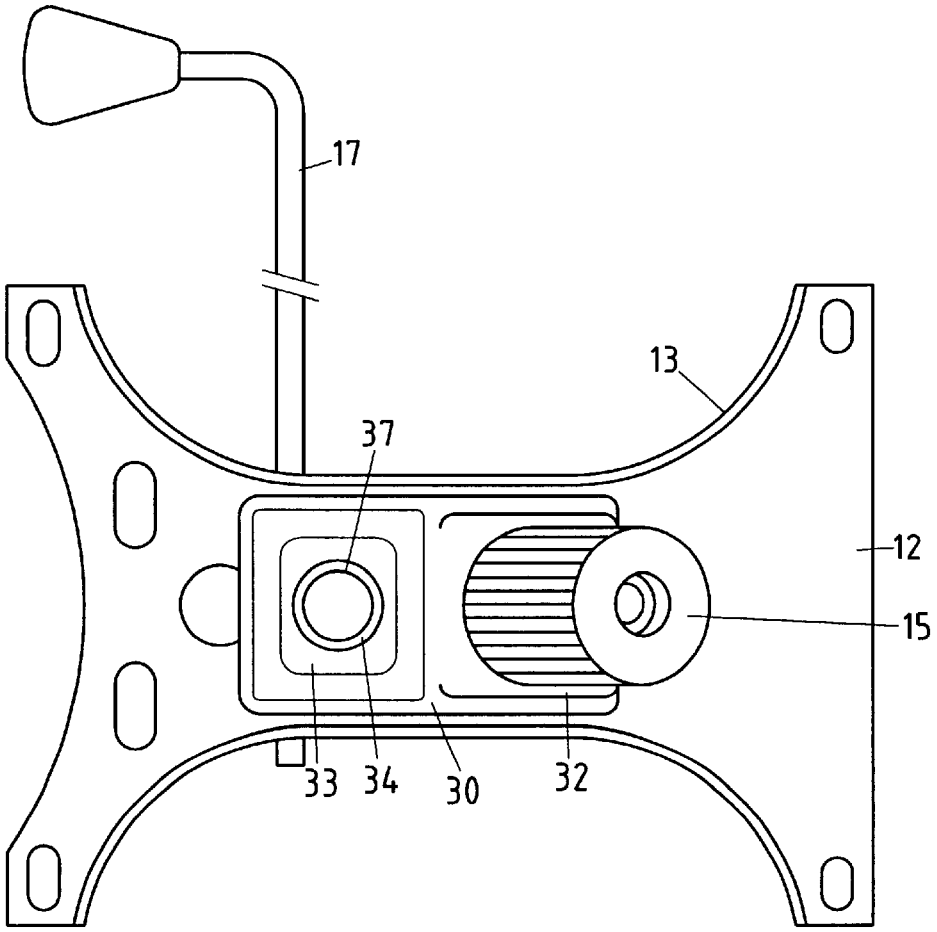
FIG. 10 shows a bottom schematic view of the fastening structure of the present invention.
Figure 11:
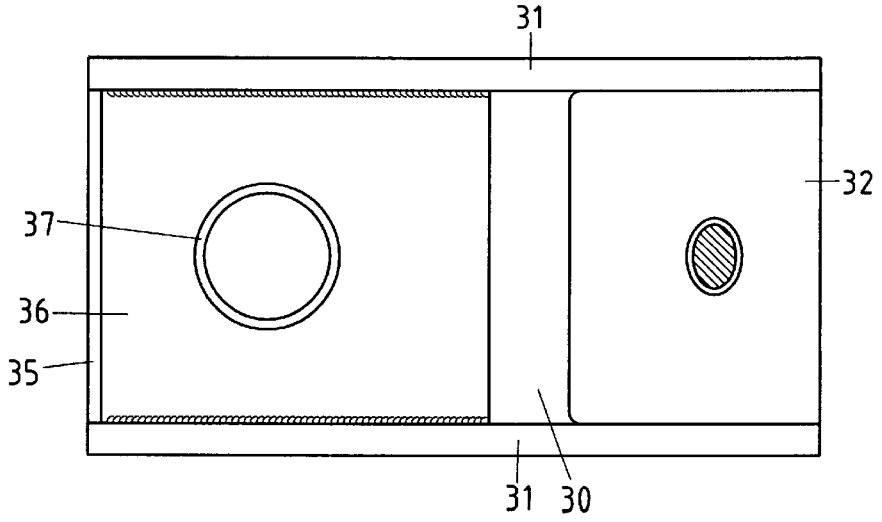
FIG. 11 shows a top schematic view of the fastening seat of the present invention.

As shown in FIGS. 6–11, a structure embodied in the present invention is intended to fasten a chair seat 11 to a support shaft 19 of the base 18 of the chair. The structure comprises a fastening plate 12, and a fastening seat 30.

The fastening plate 12 is fastened to the underside of the chair seat 11 and is provided with two arcuate ribs 13, with each having two through holes 16.

The fastening seat 30 has two ribs 31, with each having two through holes by means of which the fastening seat 30 is fastened pivotally to the fastening plate 12 by a pivot 14 and a wrenching rod 17. Located between the fastening plate 12 and the fastening seat 30 is a locating plate 36 having a though hole 37 corresponding in location to a through hole 34 of the fastening seat 30 for receiving the support shaft 19 of the base of the chair. The fastening seat 30 is provided with a recessed portion 32 for disposing an elastic member 15 which is linked with the fastened seat 12. The fastening seat 30 is provided with a circular step 35. The fastening seat 30 is characterized by a tapered protrusion 33 which is made integrally with the fastening seat 30. The tapered protrusion 33 is provided with the fitting through hole 34.

I claim:

1. An apparatus comprising:

a chair having a seat;

a support shaft extending upwardly from a base of said chair;

a fastening plate fastened to an underside of said seat of the chair said fastening plate having two arcuate ribs extending downwardly therefrom;

a locating plate having a flat planar configuration having a through hole formed therein; and a fastening seat having two ribs, said fastening seat pivotally fastened by a pivot to said fastening plate, said locating plate being disposed between said fastening plate and said fastening seat, said fastening seat having a tapered protrusion integrally formed therewith, said tapered protrusion having a through hole formed therein, said through hole of said tapered protrusion aligned with said through hole of said locating plate such that the support shaft extends therethrough, said locating plate slidably received between said two ribs of said fastening seat.

* * * * *